US005884949A

United States Patent [19]

Leon et al.

[11] Patent Number: 5,884,949

[45] Date of Patent: Mar. 23, 1999

[54] SECURITY SEAL

[75] Inventors: Jeremy Phelps Leon, Morris Township; Donald Arthur Ruth, Newton, both of N.J.

[73] Assignee: E.J. Brooks Company, Livingston, N.J.

[21] Appl. No.: 878,403

[22] Filed: Jun. 18, 1997

Related U.S. Application Data

[63] Continuation of Ser. No. 591,710, Jan. 25, 1996, abandoned.

[51] Int. Cl.[6] ..... B65D 27/30

[52] U.S. Cl. ..... 292/318; 292/307 R

[58] Field of Search ..... 292/315–322, 292/327–330; 24/16 PB, 662, 704.1, 704.2

[56] References Cited

U.S. PATENT DOCUMENTS

| | | | |
|---|---|---|---|
| 970,529 | 9/1910 | Miller | 292/318 |
| 1,370,612 | 3/1921 | Suydam | 292/318 |
| 3,146,012 | 8/1964 | King | 292/322 |
| 3,562,870 | 2/1971 | Sund | 24/16 PB |
| 3,588,961 | 6/1971 | Farago | 24/16 PB |
| 3,591,223 | 7/1971 | Lima Castro Neto . | |
| 3,712,655 | 1/1973 | Fuehrer . | |
| 3,717,369 | 2/1973 | Stoffel et al. . | |
| 3,739,429 | 6/1973 | Kohke | 24/16 PB |
| 3,875,618 | 4/1975 | Schuplin | 24/16 PB |
| 4,229,031 | 10/1980 | Guiler . | |
| 4,240,183 | 12/1980 | Sumimoto | 292/319 |
| 4,248,462 | 2/1981 | Choi | 292/322 |
| 4,319,776 | 3/1982 | Moberg | 292/322 |
| 4,506,921 | 3/1985 | Swift | 292/318 |
| 4,730,615 | 3/1988 | Sutherland | 24/16 PB |
| 5,056,837 | 10/1991 | Fuehrer | 292/307 |
| 5,337,503 | 8/1994 | Goby | 292/318 |
| 5,441,316 | 8/1995 | Georgopoulos . | |
| 5,517,728 | 5/1996 | Woods | 24/16 PB |
| 5,522,627 | 6/1996 | Swift | 292/319 |
| 5,524,945 | 6/1996 | Georgopoulos | 292/318 |
| 5,535,491 | 7/1996 | Allport | 24/704.1 |
| 5,568,952 | 10/1996 | Ruegg | 292/307 A |

FOREIGN PATENT DOCUMENTS

| | | |
|---|---|---|
| 2 164 003A | 3/1986 | United Kingdom . |
| 2 168 654A | 6/1986 | United Kingdom . |

*Primary Examiner*—Steven N. Meyers
*Assistant Examiner*—Gary Estremsky
*Attorney, Agent, or Firm*—William Squire

[57] ABSTRACT

A rigid base interconnects a pair of spaced legs, one of the legs being resiliently hinged to the base. A locking socket with a cavity is secured to an end of one of the legs distal the base and a locking stud is secured to the end of the other leg distal the base, the stud for manual resilient insertion into the socket cavity. The stud is rectangular having a wide transverse dimension and includes a locking tip with at least one barb which extends along the width. A U-shaped spring steel female locking member is secured in the socket cavity and has at least one locking tang to engage the at least one barb. The U-shaped member comprises any one of a plurality of different tang arrangements each for engagement with the same given barb configuration and are randomly assembled to the sockets of different seals. The studs of a plurality of seals include different barb configurations each engagable with any of the tang arrangements and are randomly assembled to the seals, the various combinations of barb configurations and tang arrangements providing enhanced tamper resistance.

25 Claims, 5 Drawing Sheets

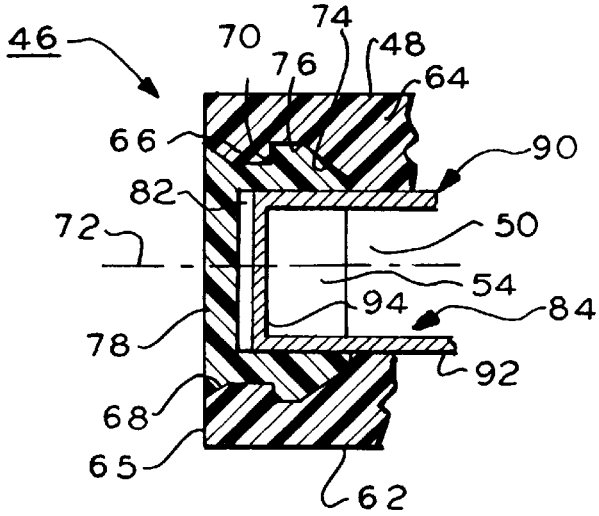
FIG. 4
FIG. 3
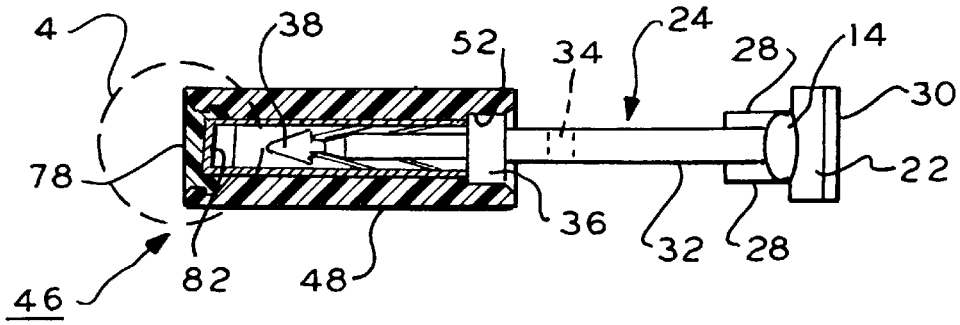
FIG. 5
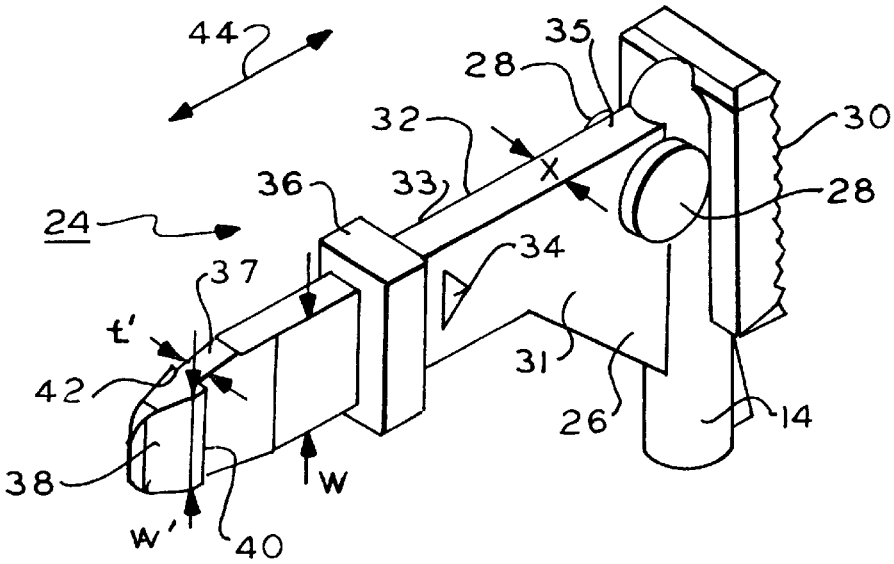

FIG. 6a
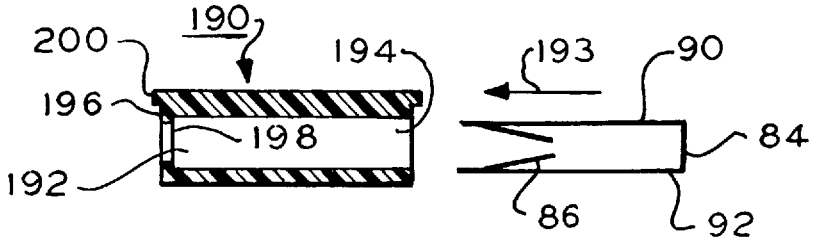
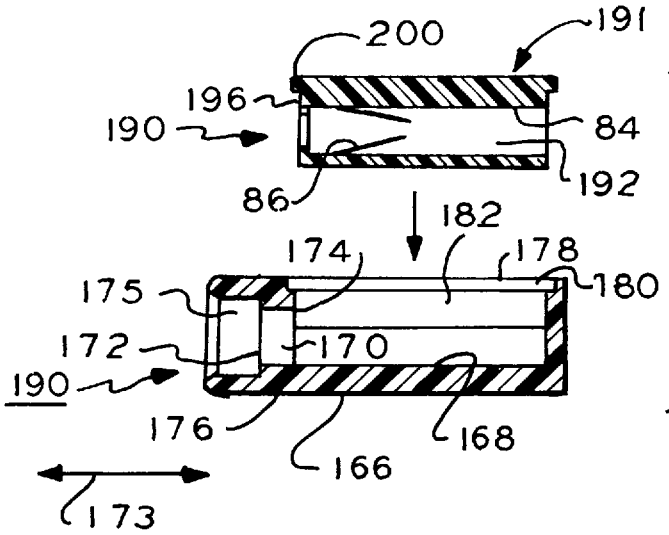
FIG. 6b
FIG. 6c
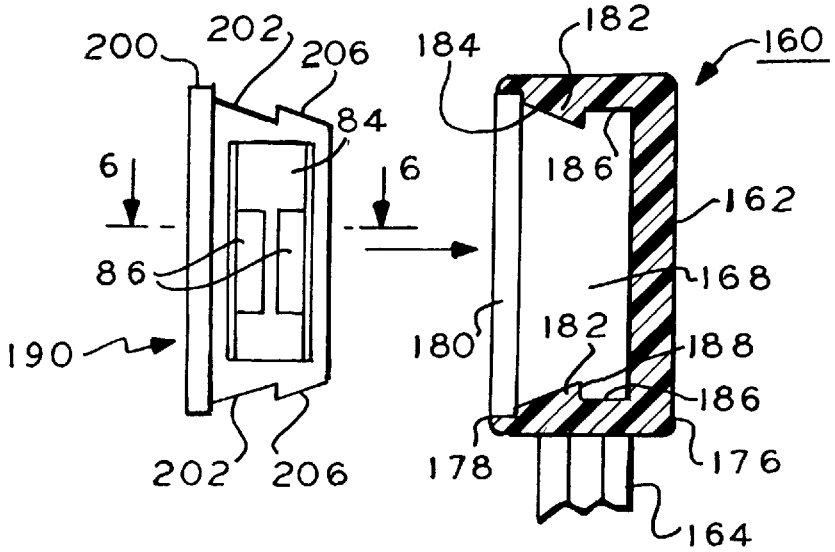

SECURITY SEAL

This application is a continuation of application Ser. No. 08/591,710 filed Jan. 25, 1996 now abandoned.

This invention relates to security seals, and more particularly, to high security molded thermoplastic seals for providing tamper evidence.

Of interest are copending commonly owned patent applications Ser. No. 272,253 entitled Security Seal filed Jul. 8, 1994 in the name of Allan W. Swift and Ser. No. 357,873 entitled Seal filed Dec. 16, 1994 in the name of George Georgopoulos which is a continuation-in-part application of U.S. Pat. No. 5,441,316.

In U.S. Pat. No. 4,319,776 issued in 1982, a security seal is disclosed comprising a single piece molded thermoplastic member having a pair of resilient legs mounted on a base and carrying on their free ends respective locking stud and socket members adapted to be locked when engaged when the legs are flexed together. An additional spring is between the legs and is flexed when the legs are flexed together. If the stud is not securely locked, the spring and flex forces of the flexed legs separates the legs.

A similar arrangement is disclosed in U.S. Pat. No. 4,506,921 wherein in place of resilient legs, a movable leg is hinged to a rigid base from which extends a non-movable leg. A tension spring extends around the outside of the hinge and is joined at the ends to adjacent portions of the movable leg and the base. The spring forces the legs apart when the stud is not securely locked opening the seal.

In both of the above structures the stud is unlocked by severing the stud from its associated leg providing tampering evidence. In the '921 patent, the stud has an arrowhead shaped tip with a transverse shoulder adjacent to a reduced cross section area attached to the associated leg. A manual force applied to the legs to separate them causes the arrowhead tip to break free from the rest of the stud. Once this happens the seal is no longer useful, providing tamper evidence.

U.S. Pat. Nos. 4,229,031 and 3,717,369 show seals configured somewhat similarly to the above noted patents. U.S. Pat. No. 3,712,655 discloses a somewhat different arrangement in which an all plastic seal has a socket for receiving a locking head connected to a strap. The socket is open at both ends and access to the inserted locking head is precluded.

Other kinds of seals are also widely used, such as for example, as disclosed in commonly owned U.S. Pat. No. 5,441,316 in which flat locking tangs are tethered at the end of a strap which is secured to a locking socket at the strap other end.

All of the above comprise a circular cylindrical arrow head type male locking member insertable into a female circular cylindrical socket. Because the configurations of all of the above seals are similar, a tamperer knows how to pick and defeat the sealing action of these seals. In some instances it is desired to provide a high security seal wherein the tamperer does not have access to the locking configuration. Unfortunately, because all of the typical prior art seals are made similarly, a tamperer can learn their particular locking configuration for purposes of picking the locking mechanism and defeat the seal lock.

The present inventors recognize a need for a seal having an arrangement wherein the seal is of high security and which is not easily defeatable by a tamperer.

A security seal according to the present invention comprises a housing having a cavity having an opening to the ambient. A shackle having opposing ends is secured to the housing at one shackle end. A male locking means is secured to the other shackle end and comprises a given barb configuration of at least one barb. A female locking means is secured to the housing within the cavity, the female locking means comprising any one of a plurality of different tang locking arrangements each including at least one tang for locking engagement with the at least one barb, the male locking means being received through the housing opening for locking engagement of the at least one barb with the at least one tang regardless the arrangements of the further tangs.

In one embodiment, the shackle comprises first and second legs each having proximal and distal ends and means for coupling the proximal ends and for positioning the distal ends in spaced relation forming a one piece molded thermoplastic construction with the legs, the means for coupling and the legs being arranged so that the distal ends can be manually displaced toward each other.

In a further embodiment, the male locking means comprises a stud secured to the shackle and extending in a longitudinal direction, the stud being substantially rectangular transverse the longitudinal direction and having a width and a thickness and opposing broad surfaces, the width being greater than the thickness, the at least one locking barb extending along the stud width and formed in one of the surfaces.

In a further embodiment, the stud includes a further barb formed in a surface opposing the one surface and of like dimensions as the at least one locking barb.

In a still further embodiment, a first pair of barbs is arranged in tandem and formed in the one surface, at least one of the first pair of barbs for engagement with the at least one tang.

In a further embodiment, the barbs are rectangular transverse the longitudinal direction and are separated by a linear recess therebetween extending along the width.

In a further embodiment, the cavity opening receives the at least one barb in a longitudinal direction, the female locking means including a metal member secured in the cavity and including the at least one tang depending from the member.

In a further embodiment, the metal member includes a pair of tangs depending from the m ember in tandem order in the longitudinal direction.

In a still further embodiment, the cavity has a depth value in the longitudinal direction, the depth value being sufficient for the cavity to receive at least a pair of tandem arranged spaced barbs in the longitudinal direction, the metal member being selected from a group of members each including one or more tangs which depend from a given member in any one of a plurality of different spaced orientations and relationships in the longitudinal direction.

IN THE DRAWING

Figure 2:
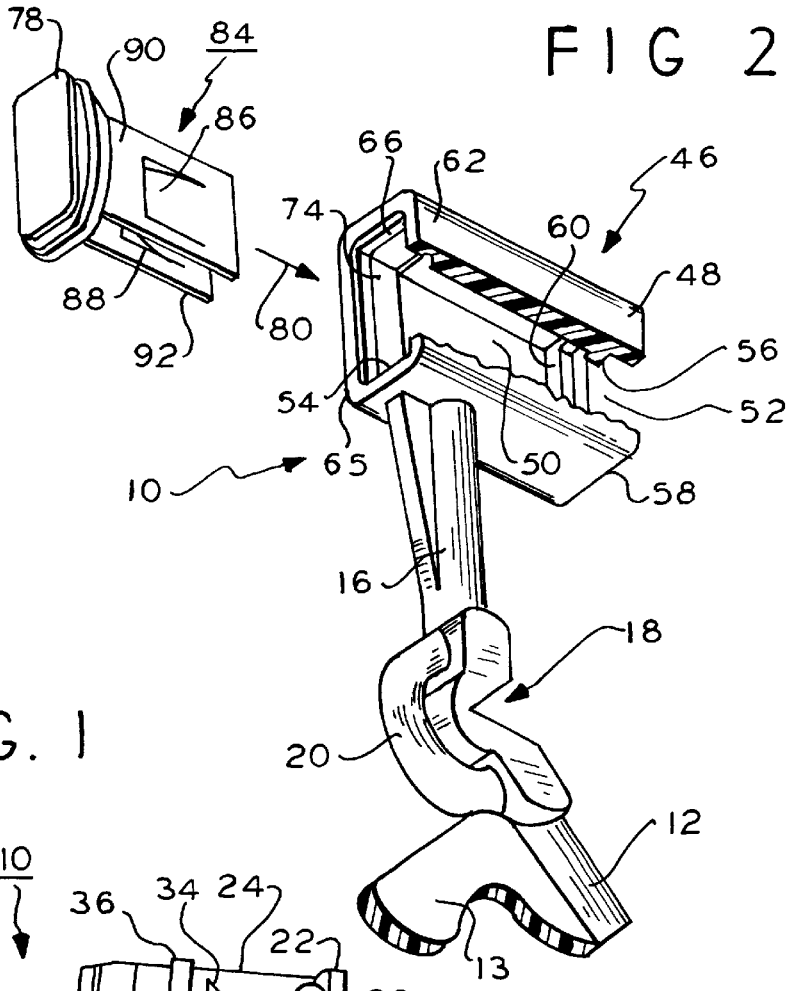
FIG. 2 is an exploded fragmented partially in section isometric view of the female socket portion of the seal of FIG. 1.
Figure 1:
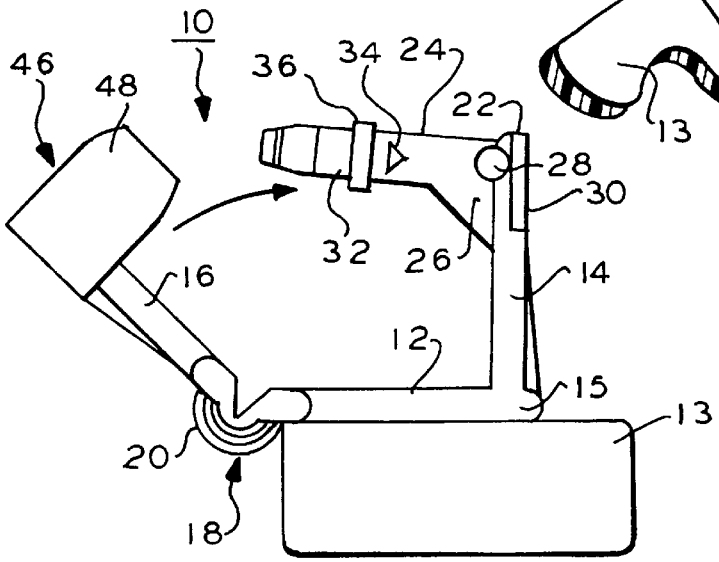
FIG. 1 is an elevation side view of a seal in accordance with one embodiment of the present invention.
Figure 2A:
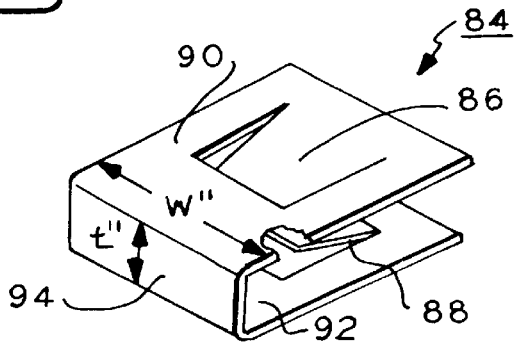
Figure 6:
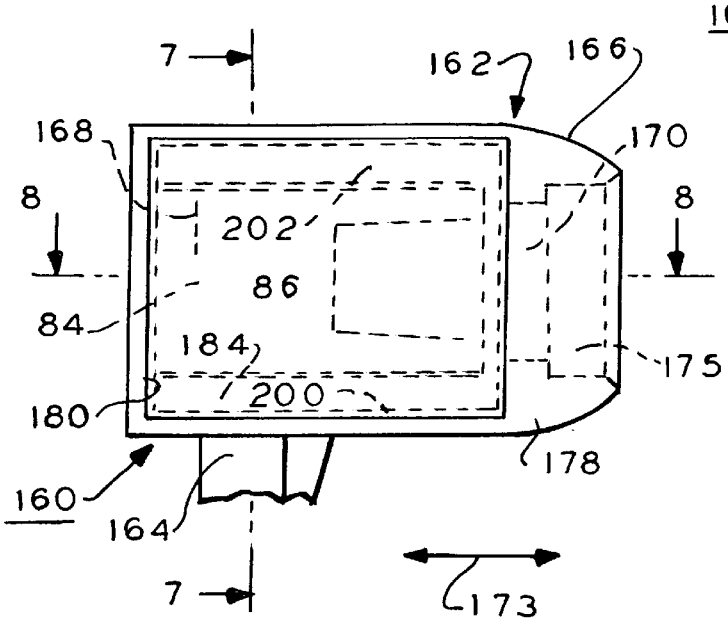
Figure 7:
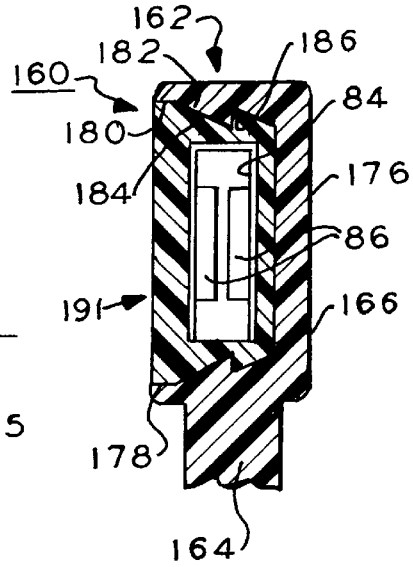
Figure 8:
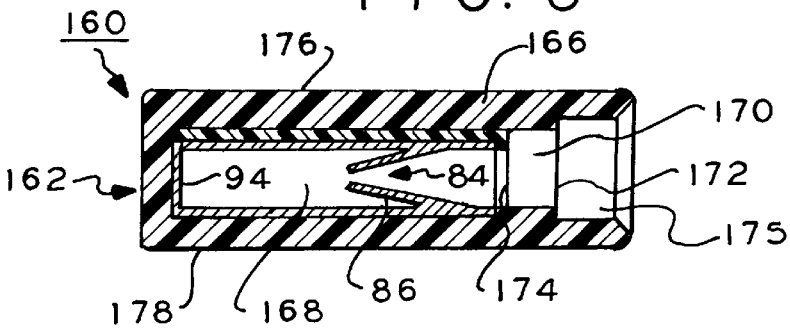
Figure 9:
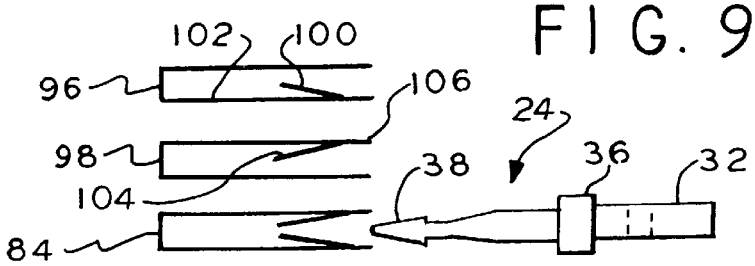
Figure 10:
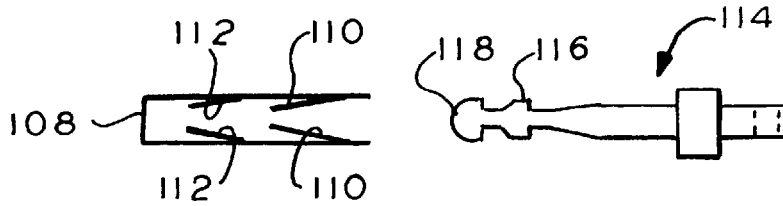

FIG. 2*a* is an isometric view of a female locking member used in the embodiment of FIG. 1;

FIG. 3 is a top plan sectional view of the seal of the present invention with the male and female locking members engaged;

FIG. 4 is an enlarged view of the embodiment of FIG. 3 taken in region 4;

FIG. 5 is an isometric view of the male locking member of FIG. 1;

FIG. 6 is a side elevation view of a socket according to a second embodiment of the present invention;

FIG. 6*a* is an exploded side elevation sectional view of a plug and female locking member of the embodiment of FIG. 6;

FIG. 6*b* is an exploded plan sectional view of the plug and locking member of FIG. 6*a* assembled and the female locking socket;

FIG. 6*c* is an exploded side elevation view of the assembled plug of FIG. 6*b* and sectional side elevation view of the socket;

FIG. 7 is an end elevation sectional view of the embodiment of FIG. 6 taken along lines 7—7;

FIG. 8 is a plan sectional view of the embodiment of FIG. 6 taken along lines 8—8;

FIG. 9 is a side elevation view of a male locking member and several female locking members which can be used with that male member in different seals;

FIG. 10 is a side elevation schematic view of a tandem male locking configuration and a female member arrangement which can be used with the male locking configuration shown or a different male locking configuration.

Figure 11:
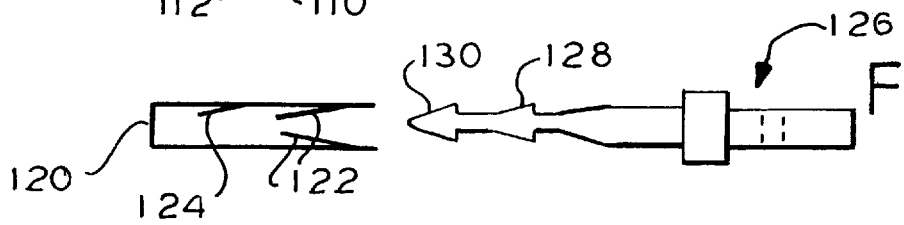

FIG. 11 is a side elevation schematic view of a tandem male locking configuration and a female member arrangement which can be used with the male locking configuration shown or a different male locking configuration.

Figure 12:
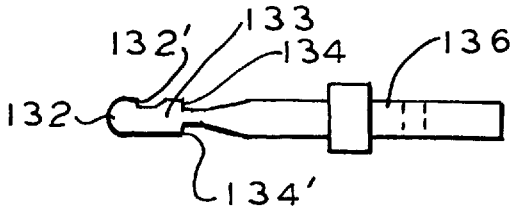

FIG. 12 illustrates a side elevation view of a male locking member for use with any of the illustrated female locking members.

Figure 13:
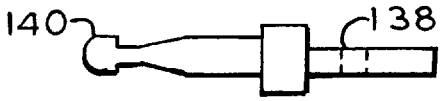

FIG. 13 illustrates a side elevation view of a male locking member for use with any of the illustrated female locking members.

Figure 14:
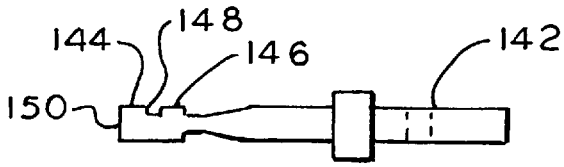

FIG. 14 illustrates a side elevation view of a male locking member for use with any of the illustrated female locking members.

Figure 15:
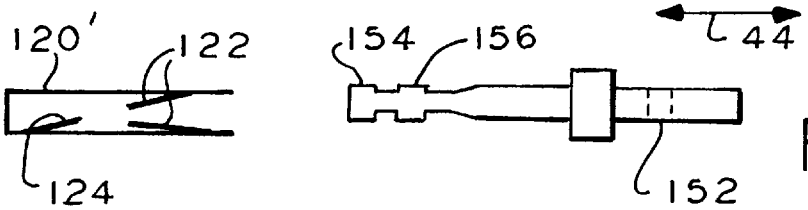

FIG. 15 illustrates a further male locking member configuration and a further female locking member arrangement.

In FIGS. 1 and 2, seal 10 comprises a rigid base 12 including a flag 13, a relatively non-movable rigid leg 14 upstanding from one end 15 of the base 12 and a movable flexible leg 16 hinged to the base 12 other end by living hinge 18. The leg 16 normally diverges from the fixed leg 14 in its quiescent state as shown in FIG. 1. An arcuate tension spring 20 is external hinge 18 and is coupled at its ends to leg 16 and base 12. The spring 20 urges the legs to the state shown. The spring 20 and hinge 18 are molded thermoplastic material with the leg 16, base 12, flag 13, leg 14 and stud 24. The legs are manually resiliently forced toward each other into the locking state of FIG. 3, to be described below. This hinge structure is generally shown and described in U.S. Pat. No. 4,506,921 incorporated by reference herein. The legs 14 and 16, base 12 and stud 24 together form a shackle.

Extending cantilevered from the end 22 of leg 14 distal the base 12 is a relatively stiff flat generally rectangular in transverse section stud 24. The stud 24 is attached to leg 14 and reinforced with gusset 26. A circular cylindrical projection 28 is on each side of member 24 at the junction with the leg 14. The projection 28 provides tamper evidence should a tamperer attempt to sever the stud 24 at leg 14 across its junction with the gusset 26. An attempt to cut the projection 28 will leave an observable seam midway therein. A cut through the gusset other than at the junction with the leg 14 also leaves an observable seam. A cut at the seam between the leg 14 and stud 24 without projections 28 may not be otherwise noticeable. Thumb engaging serrations 30 are on the leg 14 to enable firm gripping of the leg 14 during locking of the seal 2. Other gussets further rigidify the leg 14 relative to the base 12.

In FIG. 5, stud 24 has a rectangular stem portion 32 and a triangular transverse through hole 34 forming a weakening section in the stem portion 32. Portion 32 has a width w transverse directions 44 and a thickness t. The width w is substantially greater than the thickness t providing opposing broad surfaces 31 and 33. An anti-picking rectangular blocking flange 36 surrounds the stem portion 32. The hole 34 is between the flange 36 and leg 14, FIG. 1. The stem portion 32 on either side of the flange 36 transverse the longitudinal directions 44 and extending toward leg 14 is of generally uniform rectangular cross section. The hole 34 permits the stem portion 32 to be manually transversely broken at this location.

The stem portion 32 tapers on the broad surfaces 31 and 33 and the narrower lateral edges 35 to a narrower width and reduced thickness section 37 to arrow head-like tip 38. The reduced thickness forms shoulders 40 and 42 upstanding normal from the respective opposing broad surfaces 31 and 33. The shoulders 40 and 42 are planar and extend linearly fully across the stem portion 32 of stud 24 normal to longitudinal directions 44 forming locking barbs. The transverse stem portion 32 width w' at shoulders 40 and 42 is substantially greater than the thickness t' at the shoulders 40 and 42. For example, the transverse width w' may be approximately 0.140 inches (3.5 mm) at the shoulders as compared to a thickness t' of approximately 0.035 inches (1 mm).

These relative dimensions provide a relatively stronger locking barb as compared to significantly narrower width locking male barbs in prior art seals, especially those that are generally circular cylindrical. The increased strength is provided because the shoulders 40 and 42 have a significantly increased contact dimension with the mating female locking tangs to be described below as compared to prior art seals.

A socket 46 is attached to the end of the leg 16 distal the base 12 and hinge 18. Socket 46 comprises a housing 48 having a generally rectangular cavity 50 whose broad sides are formed by housing side walls 62 and 64. The housing 48 has a generally rectangular stud receiving opening 52 at housing end 58 in communication with the cavity 50. A second generally rectangular opening 54 is at the other end 65 of the housing 48 in communication with the cavity 50.

An annular rectangular in transverse section rib 56 is recessed in the opening 52 spaced from the housing end 58. The rib 56 forms an annular shoulder 60 in the cavity 50. The rib 56 and shoulder 60 need not be annular, but may be formed as two parallel opposing ribs and shoulders in the cavity 50 on opposite side walls 62 and 64 of the housing 48.

At the housing 48 other end 65, FIG. 4, an annular rib 66 forming a rectangular opening to the cavity 50 extends about the cavity 50 recessed slightly from housing end 65. The rib 66 has an externally facing inclined wall 68 which enlarges toward end 65 and an interiorly facing planar shoulder 70 normal to the longitudinal axis 72 of the cavity 50. An inclined further annular wall 74 is interior the rib 66 wall 70 spaced from the wall 70 by cylindrical groove 76. The rib 66 forms an enlarged opening as compared to the transverse dimensions of the cavity 50 interior thereof.

A plug 78 has peripheral outer diametrical dimensions which closely match the interior dimensions of the cavity 50, rib 66, shoulder 70, groove 76 and wall 74 in mirror image relationship. The plug 78 is formed of molded somewhat resilient but relatively rigid thermoplastic material. Plug 78 has a rectangular recess 82 which is in communication with the cavity 50 when the plug is locked to the housing 48, FIG. 4. The plug 78 snap fits into place by insertion in the direction 80, FIG. 2, into the cavity 50. Once the plug is inserted into position, it locks in place and can not be easily removed from the housing 48 without damaging the plug and/or housing 48.

A female locking member 84, FIGS. 2 and 2*a*, is U-shaped stamped spring steel. A pair of locking tangs 86 and 88 in mirror image relation are formed from respective corresponding legs 90 and 92. Legs 90 and 92 are interconnected by cross member 94. Legs 90 and 92 are planar sheet material as are tangs 86 and 88. The tangs depend inwardly toward each other as shown. The locking member 84 has a relatively broad width w" as compared to its thickness t" to fit closely within the rectangular cavity 50.

The member 84 cross member 94 and legs 90 and 92 are closely received within the recess 82 of the plug 78, FIG. 4. This produces a subassembly comprising the plug 78 and locking member 84, FIG. 2. The extended edges of the legs 90 and 92 abut the corresponding inner surfaces of the shoulder 60 of rib 56, FIG. 2, locking the legs 90 and 92 between the housing 48 and the plug 78. Because the plug is locked to the housing 48, the locking member 84 is locked immobile in the cavity 50. The plug is locked in place to the housing by snap engagement with the mating surface features of the housing 48 upon insertion of the plug into the cavity 50, direction 80, FIG. 2.

In operation, with the plug 78 and locking member 84 in place as shown in FIG. 3, the stud 24 is pushed into engagement with the cavity 50 until the shoulders 40 and 42 of the stud, FIG. 5, engage the locking tangs 86 and 88 of the locking member 84, FIG. 3. In this position, the blocking flange 36 of the stud 24 is closely received in the opening 52 to the cavity 50. The blocking flange assists in protecting the seal 10 from picking by precluding easy entrance of picking tools into the tang portion of the cavity 50. The relatively broad surfaces of the stud locking shoulders 40 and 42 and mating tangs 86 and 88 of the locking member 84 provide relatively strong resistance to an attempt to disengage the locked engagement of the stud to the socket 46.

In FIG. 9, the female locking member is fabricated in assorted arrangements illustrated by members 96 and 98 in comparison to member 84. Members 96 and 98 are merely reversed mirror images of one another. Member 96 has a locking tang 100 which depends upwardly from leg 102. Member 98 has a locking tank 104 which depends downwardly from leg 106. In essence, the members 96 and 98 are the same except for their relative orientation when assembled to the housing 46. The legs of these members are dimensioned identically except for the number of locking tangs.

The locking members 84, 96 and 98 are interchangeable to form a given seal socket. The locking members are assembled to various plugs 78 in random and in random orientations. The plug-locking member assemblies are then assembled to the housings randomly so that the locking member tang arrangement is different for different seals. This provides increased security because a tamperer does not know which tang arrangement and orientation is present in a given seal. Regardless which locking member is used, it installs identically to the plug 78 and into the cavity 50 of the housing 48.

To provide even further increased security the locking members may employ still further tangs. In FIG. 10, for example, locking member 108 comprises two pairs of tandem tangs 110 and 112. This arrangement may be used with the stud 24 of FIG. 5. The stud tip 38 may be dimensioned from the blocking flange 36 so as to engage either the pair of tangs 110 or the pair of tangs 112. This provides further different engagement possibilities to the seal 10. In this case, the stud 24 as fabricated may be fabricated of different lengths so as to engage a selected pair of tangs. To provide the seal of FIG. 2 with the additional capability to receive the locking member 108 while using an embodiment of the locking member 84, different stud lengths are fabricated to match a given socket length and locking member length.

However, the arrangements of FIG. 9 for the locking members may be provided the locking members having a length of member 108, FIG. 10. That is the tangs 112 may be omitted in FIG. 10. In this arrangement, the stud tip has a length from the blocking flange to engage the forward tangs 110 at least one of which is always present. Also, while opposing pairs of tangs are present in FIG. 10, single tangs on only one side of the locking member may be present to provide additional locking variations as shown in FIG. 9. Thus, regardless which locking members of FIGS. 9 and 10 are used the same thermoplastic molded socket and stud configuration is employed.

In FIG. 10, to provide a further possible locking arrangement, the configuration of the locking stud may also differ from seal to seal. In this configuration, the locking stud 114 employs two arrow head tips 116 and 118 arranged in tandem. The tip 116 engages the tangs 110 and the tip 118 engages the tangs 112. It will be apparent that the stud 114 may also be used to engage the tangs of members 84, 96 and 98 of FIG. 8. Here, the forward tip 118 does not engage any tangs, The tip 118 is a blunt circular cylinder segment, but is elongated into the Fig. as illustrated for stud 84, FIG. 5.

In FIG. 11, a further locking member 120 arrangement is shown in which there are a pair of forward tangs 122 but only one rearward tang 124. The rearward tang may be oriented in two opposing relations when installed into a socket as shown for member 96 and 98, FIG. 9, and as illustrated in FIG. 15, locking member 120'. The difference between locking members 120 and 120' is their relative orientation in the socket 46 cavity 50. The locking member 120 can also receive and lock to the stud 114 of FIG. 10 and the stud 24 of FIG. 5. Further, a stud 126 of a different configuration may be provided in which two pairs of tapered tips 128 and 130 are provided in tandem.

Further stud configurations are illustrated in FIGS. 12–14. These are not different embodiments of the stud, but are different configurations usable on different seals each with a socket of the same dimensions. In FIG. 12 the tip 132 has a locking shoulder 132' on only one side of the stud 136. Tip 133 has two locking shoulders 134, 134' in opposing relation on opposite sides of the stud 136, with shoulder 134 in tandem with the tip 132 locking shoulder 132'.

FIG. 13 illustrates a stud 138 with one pair of opposing locking shoulders on tip 140 which is of the same shape as the tip 118, FIG. 10.

In FIG. 14, a further stud locking tip configuration includes a stud 142 with a pair of tandem locking tips 144 and 146. The tips 144 and 146 are rectangular in profile normal to the longitudinal directions 44. Tip 144 has a locking shoulder 148 on one broad surface of the stud 142 whereas the tip 146 has a pair of locking shoulders on the opposing broad surfaces of the stud 142. The end wall 150 of the tip 144 is planar and normal to directions 44. The tips 144 and 146 are spaced by a transversely extending rectangular channel on one stud broad surface.

In FIG. 15 the stud 152 has two pairs of tips 154 and 156, each of similar rectangular transverse shape as the tips 144 and 146, FIG. 14, except the locking shoulders are on opposite surfaces of the stud 152.

The various stud configurations of FIGS. 5 and 9–15 are all useable with the various different locking member arrangements of FIGS. 2*a*, 9–11 and 15 and usable with a commonly dimensioned housing 48.

In practice, the locking seal 10 socket 46 is molded with the various stud configurations illustrated in the different figures. The sockets 46 are all dimensioned identically for receiving a plug 78 and a female locking member. The female locking members are dimensioned with peripheral dimensions that are identical for seating snugly within the cavity 50 of the different seals and for attachment to plugs 78 randomly in the factory. This results in the various seal sockets having different locking member arrangements in different orientations as illustrated.

This is done by feeding the locking members into a feed hopper in mixed arrangements. The fed locking members are then assembled to a corresponding plug 78 and the resulting subassemblies then fed automatically to the thermoplastic molded seal bodies comprising the socket, legs and base of the seal 10 of FIG. 2 and assembled thereto. The resulting assembled seals 10 have randomly arranged locking members and random stud configurations. Consequently, the seals so assembled have a relatively high security in that while identical externally, they differ from seal to seal randomly when locked. A tamperer does not know the internal locking arrangements of the locked stud and locking tangs and this further resists tampering.

In FIGS. 6–8, a further embodiment is disclosed comprising a seal 160 having a socket 162 secured to a movable leg 164. The remainder of the seal 160 includes the same construction as the seal 10, FIG. 1 comprising the base 12, flag 13, leg 14 and stud 24. The socket 162 is different than the socket 46 of the seal 10, FIG. 1.

The socket 162 comprises a housing 166, FIGS. 6 and 6*b*, which is elongated and rectangular in transverse section. The housing 166 has a rectangular in transverse section cavity 168. An opening 170 of reduced transverse dimensions is in communication with the ambient atmosphere through a larger rectangular opening 175. The opening 170 is partially formed by rectangular in section rib 172. The larger rectangular opening 175 is external opening 170 for closely receiving the blocking flange 36 of the stud 24. The opening 170 is dimensioned to closely receive the stud 24 stem portion 32 adjacent to the flange 36 (FIG. 5) between the flange 36 and the tip 38. This is somewhat similar to the socket 46 opening 52 and the opening formed by rib 56, FIG. 2. The rib 172 has a shoulder 174.

The housing 166, FIGS. 6, 6*c*, 7 and 8, has opposing broad side walls 176 and 178. A generally rectangular annular recess opening 180 is formed in the side walls of the housing 166, FIG. 6*c*. A pair of opposing parallel ribs 182 project inwardly from housing 166 into cavity 168. The ribs 182 are inwardly of the opening 180 at the egress of the cavity 168, each rib 182 being on an opposite side wall of the housing. The ribs 182 each have an inclined inner face 184 forming an inwardly decreasing transverse width opening. A rectangular in transverse section linear channel 186 is between each rib 182 and the side wall 176. The cavity 168 has a flat face on side 176. The inward sides of the ribs 182 form a locking shoulder 188.

In FIG. 6*a*, a thermoplastic molded plug 190 has a hollow core 192. A opening 194 is formed at one end of the core 192 to permit the locking member 84 to be inserted into the core 192, direction 193. An annular rib 196 is at the other end of the core 192 forming annular shoulder 198. Shoulder 198 serves as a stop for the member 84 in the core 192. An annular flange 200 surrounds the plug 190 and mates with opening 180 in the housing 166, FIG. 7. The plug 190 has a pair of linearly extending recesses 202 having inclined bottom walls, FIG. 6*c*, and ribs 206. The recess 202 snap fit receives a housing 166 rib 182 and the plug rib 206 mates with the housing channel 186. The ribs 206 snap fit over the housing rib 182 into channel 186. This locks the plug assembly of FIG. 6*b* in the housing cavity 168. The plug 190 and the locking member 84 form a subassembly 191, FIG. 6*b*.

The subassembly 191 is inserted into the housing 166 cavity 168 in the direction of the arrow, FIG. 6*b*, until the plug snap locks into position, FIG. 7. The resulting assembly forming seal 160 is highly secure. The plug 190 has a greater snap fit rib length dimensions with the housing 166 as compared to the embodiment of FIG. 1. Because the plug assembly 191 is inserted from the side of the housing 166, the locking member 84 is secure and difficult to remove by tampering without leaving tampering damaging evidence.

All of the stud configurations and locking member arrangements of FIGS. 9–15 are useful with the embodiment of FIGS. 6–8. Thus the various combinations of locking tangs and stud locking configurations make it difficult for a tamperer to disassemble the locked stud without damaging the seal assembly.

It will occur to one of ordinary skill that various modifications may be made to the disclosed embodiments without departure from the scope of the invention as defined in the appended claims. The description given herein is by way of illustration and not limitation. For example, the shackle disclosed herein is a preferred embodiment. For example, the shackle may be in the form of a strap, a tether or other connecting arrangement between the stud and the socket. Also, the shackle may be free at both ends and the female socket member may be arranged with multiple locking recesses to lock the shackle at both shackle ends with randomly arranged barbs and tangs corresponding to each end.

Other shackle designs may also be used with the locking socket arrangements and stud configurations as described herein. These arrangements and configurations are also given by way of example. By way of further example, the locking member need not be U-shaped, but may be formed from separate flat sheet material legs or even a single flat leg with one or more tangs. The depending arrangement of the tangs is also by way of example.

Other types of tangs may also be used. The important aspect is that various combinations of tangs and stud barbs are interchangeable in a common seal housing and shackle arrangement for providing multiple locking configurations which are not detectable externally when locked.

What is disclosed is a simple sheet metal locking tang construction of numerous different arrangements which can be used with one or more different stud barb configurations in a seal that is substantially externally identical when locked to other seals with different locking tang arrangements and barb configurations.

What is claimed is:

1. A security seal arrangement for providing enhanced tampering resistance comprising:

a plurality of substantially identical housings each having a cavity with an opening in communication with the ambient atmosphere surrounding the housing;

a plurality of substantially identical shackles each having opposing ends, a shackle being secured to and corresponding to each one of said housings at one shackle end;

a plurality of substantially identical male locking means, a male locking means being secured to the other shackle end of each shackle and comprising a given barb configuration of at least one barb; and a plurality of different female locking means, each female locking means being secured to and corresponding to a different one of said plurality of housings within said cavity of the corresponding housing, each said female locking means for interchangeable attachment to any of said housings and including a plurality of tangs located in the cavity of the corresponding housing for locking engagement with the at least one barb of the male locking means of the corresponding shackle, the plurality of tangs of each of the female locking means having a tang configuration different than the tang configuration of the remaining female locking means of said plurality of female locking means, each said different tang configuration for mating and locking engagement with said given barb configuration of the corresponding male locking means, said different tang configuration including at least one tang disengaged from said given barb configuration of the corresponding male locking means in said locking engagement, the male locking means for being received through said housing opening for locking engagement of the at least one barb with at least one of the plurality of tangs in said cavity;

said shackle and said housing each including cooperating means which preclude visual observation of said engaged locked male and female locking means from said ambient atmosphere.

2. The security seal arrangement of claim 1 wherein each shackle comprises first and second legs each having proximal and distal ends and means for coupling the proximal ends and for positioning the distal ends in spaced relation forming a one piece molded thermoplastic construction with said legs, the means for coupling and the legs being arranged so that the distal ends can be manually displaced toward each other.

3. The seal arrangement of claim 1 wherein each said male locking means comprises a stud secured to said corresponding shackle and extending in a longitudinal direction, said stud being substantially rectangular transverse the longitudinal direction and having a width and a thickness and opposing broad surfaces, said width being greater than said thickness, said at least one locking barb extending along said stud width and formed in one of said surfaces.

4. The seal arrangement of claim 3 wherein the stud includes a further barb formed in a surface opposing the one surface and of like dimensions as said at least one locking barb.

5. The seal arrangement of claim 1 wherein each said male locking means comprises a stud and including a first pair of barbs arranged in tandem on the stud, at least one of said barbs of the first pair of barbs for engagement with said at least one tang.

6. The seal arrangement of claim 5 wherein the barbs are rectangular when viewed in a direction transverse to the longitudinal direction and are separated by a linear recess therebetween extending in said transverse direction.

7. The seal arrangement of claim 5 wherein the stud has opposing surfaces, said barbs being formed in one of said surfaces, said stud including a further pair of tandem barbs formed in the stud surface opposing the one surface and in mirror image to the first pair of barbs.

8. The seal arrangement of claim 3 wherein the stud terminates in a tip, said tip terminating in an end wall, said end wall being planar and substantially normal to said opposing surfaces, said opposing surfaces being parallel.

9. The seal arrangement of claim 1 wherein each said cavity opening receives each said at least one barb in a longitudinal direction, said female locking means including a metal member secured in said corresponding cavity and including said at least one tang depending from the member.

10. The seal arrangement of claim 9 wherein the metal member of at least one of said plurality of female locking means includes a pair of said tangs depending from said metal member in tandem order in said longitudinal direction.

11. The seal arrangement of claim 9 wherein the cavity has a depth value in said longitudinal direction, said depth value being sufficient for the cavity to receive at least a pair of tandem arranged spaced barbs in said longitudinal direction, said metal member for each said plurality of female locking means being selected from a group of members consisting of members each including at least one tang which depends from a corresponding member in any one of a plurality of different spaced orientations and relationships in said longitudinal direction.

12. The seal arrangement of claim 11 wherein the male locking means at least one barb comprises a plurality of barbs, said at least one tang being positioned on the metal member for engagement with at least one of said plurality of barbs.

13. The seal arrangement of claim 9 wherein the metal member is U-shaped having a pair of overlying spaced further legs for receiving the male locking means therebetween, said U-shaped member having at least one tang on at least one of said space further legs depending toward the other of said further legs.

14. The seal arrangement of claim 13 wherein the U-shaped member comprises a cross member interconnecting said further legs, each said cavity of the plurality of housings having a further opening distal said first opening in said longitudinal direction, further including a plurality of sealing plugs each for locking engagement with and corresponding to a different housing and for sealing said further opening of the corresponding housing, each said sealing plug having a recess for receiving a cross member for securing a U-shaped member to a corresponding plug for insertion into a corresponding cavity.

15. The seal arrangement of claim 9 wherein the cavity of each housing extends in said longitudinal direction, each said housing including a side wall extending in said longitudinal direction and having a further opening in said side wall and including plug engagement means, further including a plurality of plugs each corresponding to a different housing and including means for locking engagement with the plug engagement means of the corresponding housing for sealing the further opening of the corresponding housing.

16. The seal arrangement of claim 15 wherein each plug includes a recess for receiving a female metal member and for insertion of the received metal member into said cavity of the corresponding housing.

17. The seal arrangement of claim 13 wherein the at least one tang comprises a pair of tangs on one of said further legs and at least one tang on the other of said further legs.

18. The seal arrangement of claim 1 wherein each of the female locking means is selected from the group consisting of a single locking tang, a first tandem arrangement of like locking tangs, a further locking tang opposing one of said tandem arrangement of like tangs, a pair of locking tangs in spaced relation, and a second tandem arrangement of like locking tangs in spaced opposing relation to the first tandem arrangement.

19. The seal arrangement of claim 1 wherein each of the male locking means configurations comprises a stud extending in a longitudinal direction from a corresponding shackle, said stud being rectangular in section transverse the longitudinal direction and having opposing broad surfaces and at least one barb extending across at least one of the broad surfaces, said at least one barb being selected from the group consisting of a single barb, a first tandem arrangement of like barbs on one of said surfaces, a further barb on a surface opposite the one surface with said first tandem arrangement, a further tandem arrangement of barbs on said opposite surface, and at least one barb on each said opposing broad surfaces.

20. The seal arrangement of claim 19 wherein said barbs have a given shape when viewed in a direction transverse the longitudinal direction, said shape being selected from the group consisting of rectangular, square, rounded tip and tapered tip.

21. A security seal arrangement for providing enhanced tamper resistance comprising:

a plurality of substantially identical housings each having a cavity with an opening in communication with the ambient atmosphere surrounding the housing;

a plurality of shackles each having opposing ends, a shackle being secured to and corresponding to each housing at one shackle end;

a male locking means secured to the other shackle end of each said shackles and comprising a barb configuration of at least one barb, the barb configuration on the locking means associated with the different shackles being different; and a plurality of female locking means, a different female locking means for interchangeable attachment to any of said housings and being secured to and corresponding to each of the housings within a corresponding one of said cavities, each female locking means including a plurality of tangs, the configuration of the plurality of tangs being different on each said female locking means, the plurality of tangs for locking engagement with the at least one barb of an associated male locking means, the female locking means including at least one tang which is disengaged with the at least one barb of the associated male locking means in said locking engagement, the male locking means for being received through said housing opening for said locking engagement of the at least one barb with at least one of the plurality of tangs in said cavity;

said shackles and said housings each including cooperating means which preclude visual observation of said engaged locked male and female locking means from said ambient atmosphere.

22. A method of making a security seal for providing enhanced tamper resistance comprising:

forming a housing with a cavity having an opening in communication with the ambient atmosphere external to the housing;

forming a shackle having opposing ends;

securing one shackle end to the housing;

forming a male locking means with a given barb configuration of at least one barb on the other shackle end;

forming a plurality of female locking means each for interchangeable attachment to said housing, each female locking means with a different locking tang configuration, each tang configuration including a plurality of tangs for locking engagement with the at least one barb, at least one of the plurality of tangs being disengaged with the at least one barb in said locking engagement;

selecting one of said female locking means;

securing the selected one female locking means to the housing within said cavity such that passing the male locking means through said housing opening into the cavity locking engages the at least one barb with at least one tang and is disengaged with at least one other tang; and forming said shackle and said housing to cooperate to preclude visual observation of said engaged locked male and female locking means from said ambient atmosphere.

23. A plurality of locking seals for providing enhanced tamper resistance, each seal comprising:

first and second legs each leg having proximal and distal ends, the legs of each seal being substantially the same;

means for coupling the proximal ends and for positioning the distal ends in spaced relation forming a one piece molded thermoplastic construction with said legs, the means for coupling and the legs being arranged so that the distal ends can be manually displaced toward each other, the legs and means for coupling being identical for each said plurality of seals, the means for coupling for each seal being substantially the same;

a male locking means comprising at least one barb secured to the distal end of the first leg and comprising a given barb configuration for each said plurality of seals; and a female locking means secured to the distal end of the second leg, said female locking means of each said plurality of seals comprising a plurality of tangs for interchangeable locking engagement with the at least one barb and selected from a different one of a plurality of different female locking arrangements each for interchangeable attachment to the female locking means of each said plurality of seals and interchangeable locking engagement with the male member given configuration regardless the different arrangements of said female locking means of the plurality of seals, said female locking means comprising at least one tang disengaged with the at least one barb while in said locking engagement;

said male and female locking means each including cooperating means which preclude visual external observation of said engaged locked male and female locking means.

24. The seal of claim 23 wherein the male locking member of each seal is selected from the group consisting of a plurality of different locking configurations, each of said plurality of different male locking configurations for locking engagement with any of said plurality of different female locking arrangements such that each seal of the plurality of seals have a corresponding different male locking member.

25. A security seal arrangement for providing enhanced tampering resistance comprising:

a plurality of substantially identical housings each having a cavity with an opening in communication with the ambient atmosphere surrounding the housing;

a plurality of substantially identical shackles each having opposing ends, a shackle being secured to and corresponding to each one of said housings at one shackle end;

a plurality of substantially identical male locking means, a male locking means being secured to the other shackle end of each shackle and comprising a given barb configuration of at least one barb; and a plurality of different female locking means, each female locking means being secured to and corresponding to a different one of said plurality of housings within said cavity of the corresponding housing, each said female locking means for interchangeable attachment to any of said housings and including at least one tang located in the cavity of the corresponding housing for locking engagement with the at least one barb of the male locking means of the corresponding shackle, the at least one tang of each of the female locking means of said plurality of female locking means having a tang configuration different than the tang configuration of the remaining female locking means of said plurality of female locking means, each said different tang configuration for mating and locking engagement with said given barb configuration of the corresponding male locking means, the male locking means for being received through said housing opening for locking engagement of the at least one barb with the at least one tang in said cavity;

said shackle and said housing each including cooperating means which preclude visual observation of said engaged locked male and female locking means from said ambient atmosphere;

each cavity opening receiving the at least one barb in a longitudinal direction, each female locking means including a U-shaped metal member secured in the corresponding cavity;

the metal member having a pair of overlying spaced legs for receiving the male locking means therebetween, said U-shaped member having at least one tang on at least one of said spaced further legs depending toward the other of said further legs.

* * * * *